United States Patent [19]

Felter

[11] 4,242,055

[45] Dec. 30, 1980

[54] ATTIC FANS AND APPARATUS FOR SUPPORTING THE DRIVE MOTORS OF ATTIC FANS

[76] Inventor: John V. Felter, Austin, Tex.

[21] Appl. No.: 934,510

[22] Filed: Aug. 17, 1978

[51] Int. Cl.[3] ..... F04B 35/04

[52] U.S. Cl. ..... 417/362

[58] Field of Search ..... 417/362; 74/207, 209; 248/665; 416/60, 174, 214

[56] References Cited

U.S. PATENT DOCUMENTS

| | | | |
|---|---|---|---|
| 1,802,451 | 4/1931 | Summers | 248/665 X |
| 2,385,152 | 9/1945 | Morrison | 417/362 |
| 2,601,030 | 6/1952 | Klein et al. | 417/362 X |
| 2,811,034 | 10/1957 | Hintor | 417/362 X |
| 2,939,627 | 6/1960 | Greinor | 417/362 X |
| 3,198,460 | 8/1965 | Goettl | 248/665 |
| 4,108,580 | 8/1978 | Felter | 417/362 |

FOREIGN PATENT DOCUMENTS

| | | | |
|---|---|---|---|
| 2448623 | 4/1976 | Fed. Rep. of Germany | 417/361 |

*Primary Examiner*—Richard E. Gluck

*Attorney, Agent, or Firm*—Carl B. Fox, Jr.

[57] ABSTRACT

Attic fans and apparatus for supporting the drive motors of attic fans, the attic fans being of the type having a housing connected around the sides of a rectilinear aperture through a wall, usually the ceiling of a home or building, the housing having a circular opening within which radially disposed fan blades mounted on a central shaft are rotated. In the attic fan shown herein, the blades are supported between spaced plates rotatively carried on the shaft. The shaft is supported at its lower end by a plurality of radially disposed supports, and is supported at its upper end by a single radial disposed support. The drive motor is supported at one side of the circular opening through the housing by a rod extending from the upper radial support to the housing. A support plate element pivotally connected to the rod has upper and lower inturned portions which engage the motor. The inturned portions of the support element have lugs engaged by a pair of straps which are bolted together at their adjacent ends so that the straps may be tightened around the motor mounting surfaces.

5 Claims, 5 Drawing Figures

ATTIC FANS AND APPARATUS FOR SUPPORTING THE DRIVE MOTORS OF ATTIC FANS

BRIEF SUMMARY OF THE INVENTION

The invention contemplates attic fans and apparatus for supporting the drive motors of attic fans. The attic fans shown herein are of the type wherein radially disposed blades are supported between parallel spaced plates rotatably carried by a central shaft. An attic fan of this type is shown in copending application Ser. No. 748,417 filed Dec. 8, 1976, now U.S. Pat. No. 4,108,580, issued Aug. 22, 1978, to which reference is made as to certain details of the apparatus not otherwise described in this application. According to the present invention, an overhead support connected to the upper end of the central shaft is provided, which also supports a vertical rod from which the drive motor is supported. The drive motor is supported by a formed plate element which pivotally connects to the rod and which engages the upper and lower ends of the drive motor so that the drive motor is fully supported thereby. The plate element connected to the rod is biased toward a drive belt tightening condition by a spring engaged between the support element and the overhead support. The overhead support and the drive belt extend in approximately the same direction whereby one opposes the other so that the central shaft is fully supported in the direction of the drive belt tension. The motor mount apparatus herein disclosed and claimed is of simple design and results in economies as compared with conventional construction. Its use eliminates the need for motor mount customarily purchased from the manufacturer, eliminates a number of screws and bolts and washers, and eliminates the expense of labor and overhead for assembly of the parts. The new structure is entirely serviceable and dependable, yet renders manufacturing cost considerably less than heretofore.

BRIEF DESCRIPTIONS OF THE DRAWINGS

DESCRIPTION OF THE PREFERRED EMBODIMENTS

Figure 1:
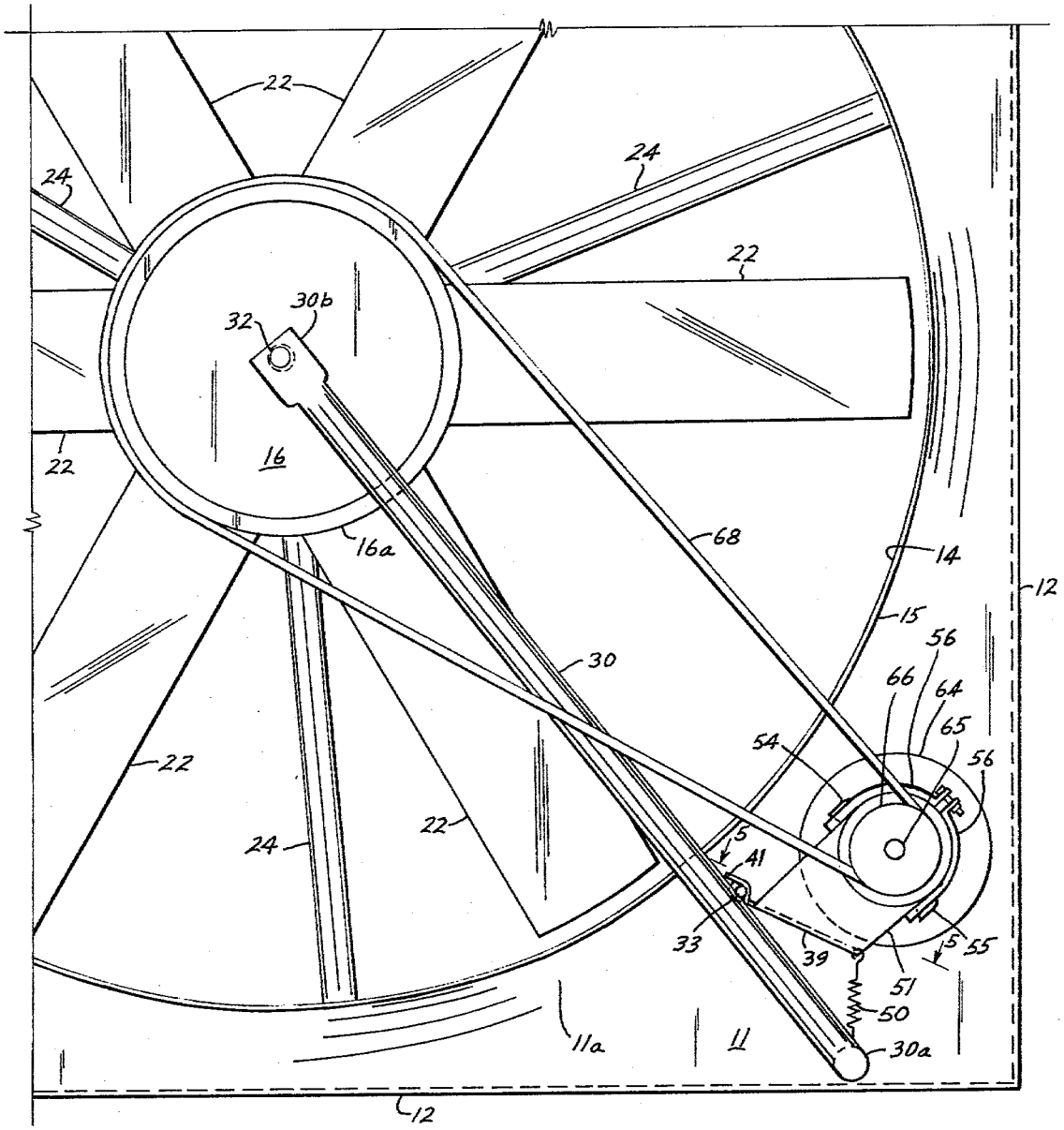
FIG. 1 is a partial upper elevation showing a preferred embodiment of apparatus according to the invention.
Figure 4:
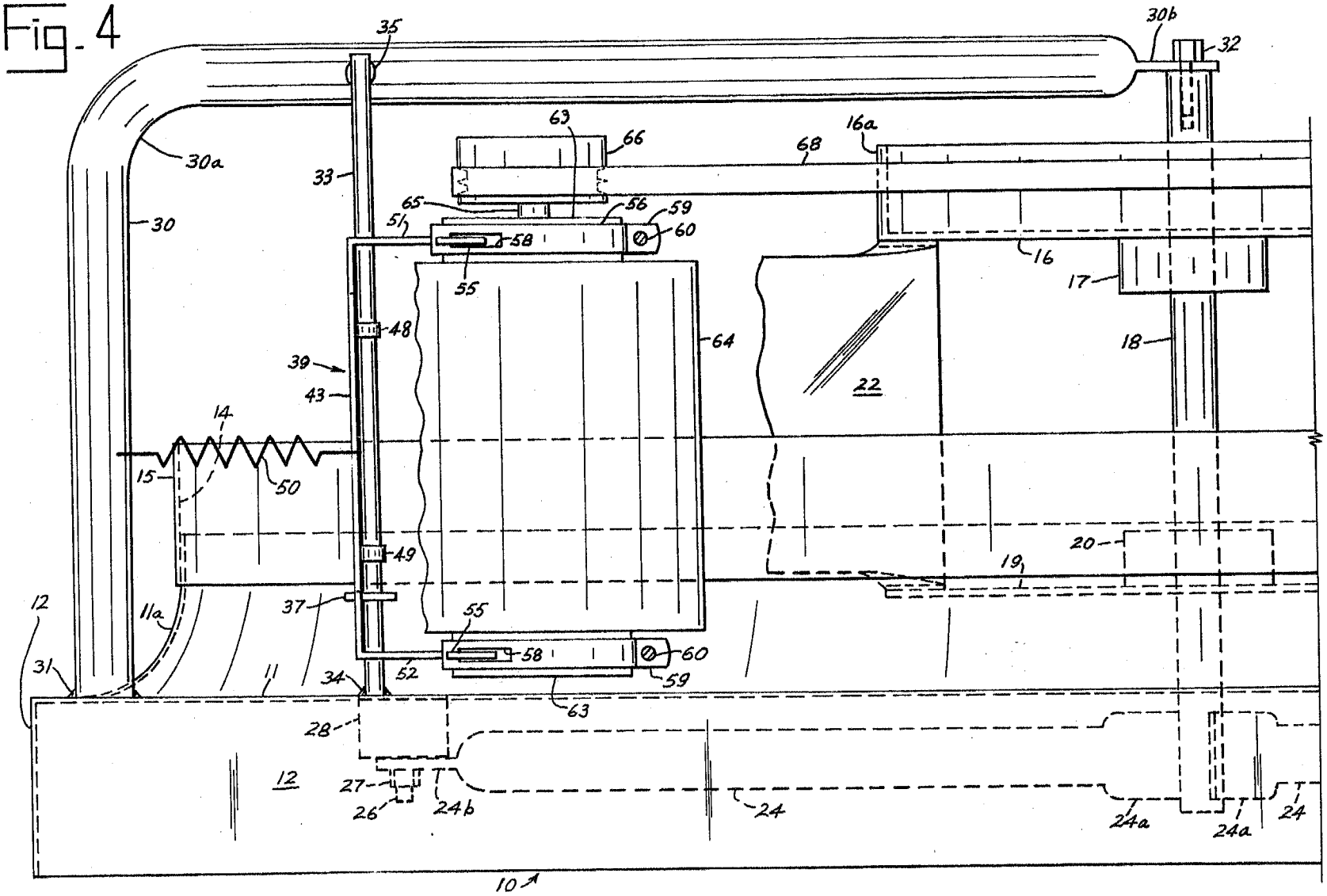
FIG. 4 is a side elevation of the apparatus shown in FIG. 1.

Referring now to the drawings in detail, and first to FIGS. 1 and 4, a housing 10 which may be square or rectangular has a flat upper wall 11 of square or rectangular outer outline and has downwardly disposed surrounding side walls 12 in the form of a skirt. Upper wall or top 11 has a central circular opening 14 the sides of which are flared upwardly at 11*a*. A circular cylindrically formed extension 15 is fitted around the upper end of flared portion 11*a* and affixed in place preferably by screws or rivets or by tack welding, not shown.

An upper plate 16 is supported by a bearing assembly 17 on a vertical shaft 18. A lower plate 19 is similarly supported on shaft 18 by bearing assembly 20. A plurality of circularly spaced blades 22 are affixed between plates 16 and 19, the details of the assembly being further explained in Ser. No. 748,417 filed Dec. 8, 1976, previously referred to. Shaft 18 is supported at its lower end by a plurality, usually three, of radially disposed tubular bars 24 the inner ends of which are flattened at 24*a* and welded to the lower end of the shaft. The outer end of each bar 24 is flattened as at 24*b* and affixed by a bolt 26 and a nut 27 to a vibration eliminating support 28 which is secured to the underside of plate or wall 11 outside of flared portion 11*a* thereof.

The upper end of shaft 18 is supported by a support bar 30 which has a bend at 30*a*. The lower end of bar 30 is welded to wall 11 at 31. The upper inner end of bar 30, which may be tubular, is flattened at 30*b* and connected by a screw 32 to the tapped upper end of shaft 18. Shaft 18 is non-rotative, the bearing assemblies 17 and 20 having fixed parts connected to shaft 18 and rotative parts disposed therearound connected to the plates 16 and 19. A cylindrical bar 33, disposed vertically, is welded to wall 11 at 34 and is welded to a side of support bar 30 at 35. Bar 33 has a circular collar 37 affixed thereto above its lower end.

A support element 39 (see also FIGS. 2 and 5 of the drawings) has spaced rectangular tabs 41, 42 at one side of sheet metal plate 43 of which element 39 is formed. Tab 41 has parallel cuts or slits 44, 45 and tab 42 has parallel cuts or slits 46, 47. The metal between cuts 44, 45 is bent away from the plate 43 in a rough U-shape at 48, the portion of plate 43 between slits 46, 47 being similarly formed at 49. The tabs are bent around one side of bar 33 and the strip portions 48, 49 are bent around the opposite side of bar 33, as shown, to hingedly connect element 43 to bar 33.

A helical spring 50 has one end connected to plate 43 at hole 50*a* and the other end similarly connected to the upright portion of rod or tube 30. Spring 50 biases plate 43 in a direction to tighten the drive belt, to be described.

Figure 5:
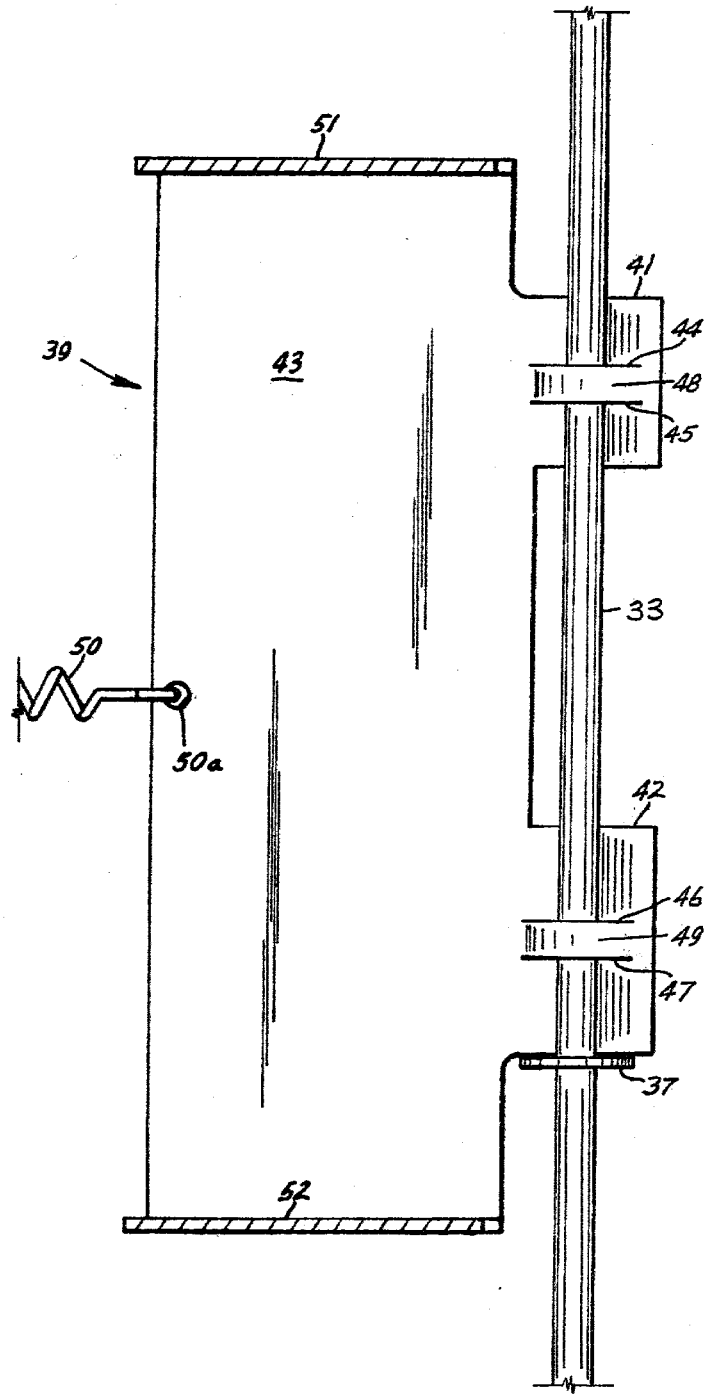
FIG. 5 is a partial vertical cross section taken at line 5—5 of FIG. 1.

The lower edge of tab 42 rests on collar 37, as is best shown in FIG. 5. Element 43 has perpendicular bent portions 51, 52 to its upper and lower ends respectively, each of which is of the shape best shown in FIG. 2. Portion 51 is of the same shape as portion 52, only portion 51 being shown in FIG. 2. Portions 51, 52 are slightly widened away from the plate portion of element 43 and terminate at opposite sides in hook shaped lug formations 54, 55. Band members 56 are disposed, one at each side, with the slot 58 thereof releasably received around one of the formations 54, 55. The end 59 of each band element 56 is outbent and perforated to receive a bolt 60 therethrough which is secured by a nut 61. Each support element portion 51, 52 has an arcuately curved side 62 against which one side of the motor support portion 63 at each end of motor 64 is disposed. The bands 56 are disposed around the other side of each motor support portion 63. After the bands 56 have been disposed in place, the screw 60 is inserted through the perforations in outbent portions 59 and secured and tightened by screwing nut 61 onto screw 60.

Shaft 65 of motor 64 has a sheave 66 affixed to its end portion about which a drive belt 68 is disposed. The drive belt 68 is preferably a V-belt or multi-V-belt, preferably the latter, the opposite end of which is disposed about an upstanding cylindrical flange 16*a* of plate 16. The pulley or sheave 66 is grooved as indicated in FIG. 4 to receive the V-belt or multi-V-belt, but the flange 16*a* is not grooved and has a smooth uninterrupted cylindrical outer surface against which the belt is engaged.

The motor mount structure shown in this application may be employed with attic fans of other characters, wherein an ordinary sheave is disposed about a shaft such as shaft 18, which may be either non-rotative or rotative.

Figure 2:
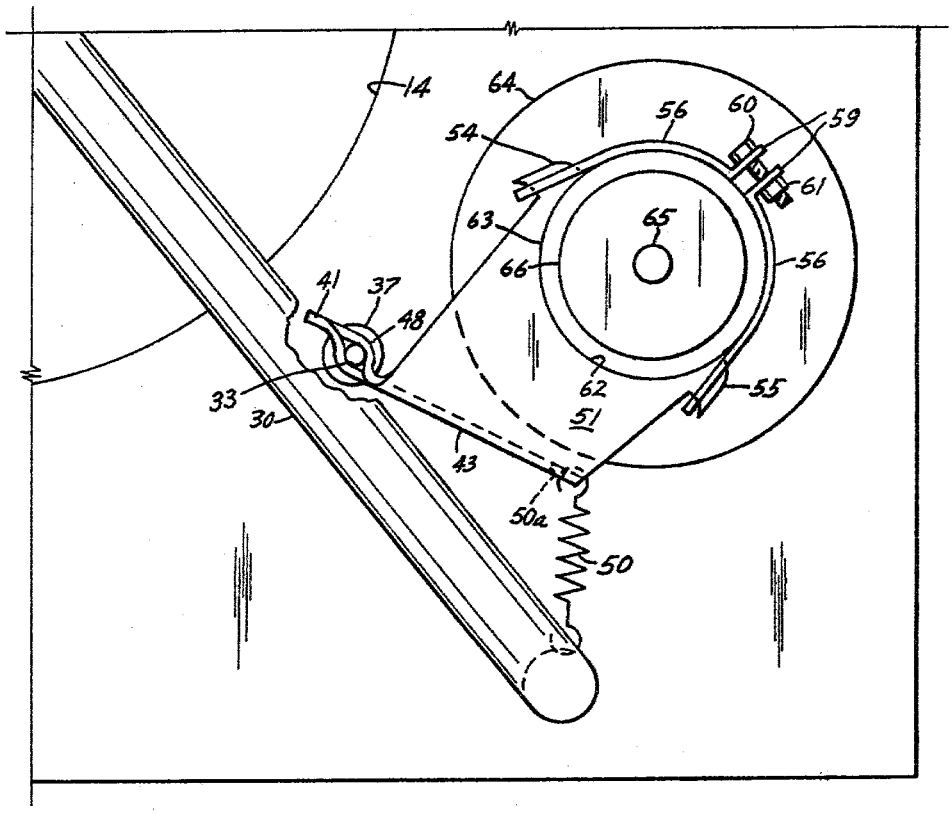
FIG. 2 is an enlarged upper elevation showing the motor support portion of the apparatus.
Figure 3:
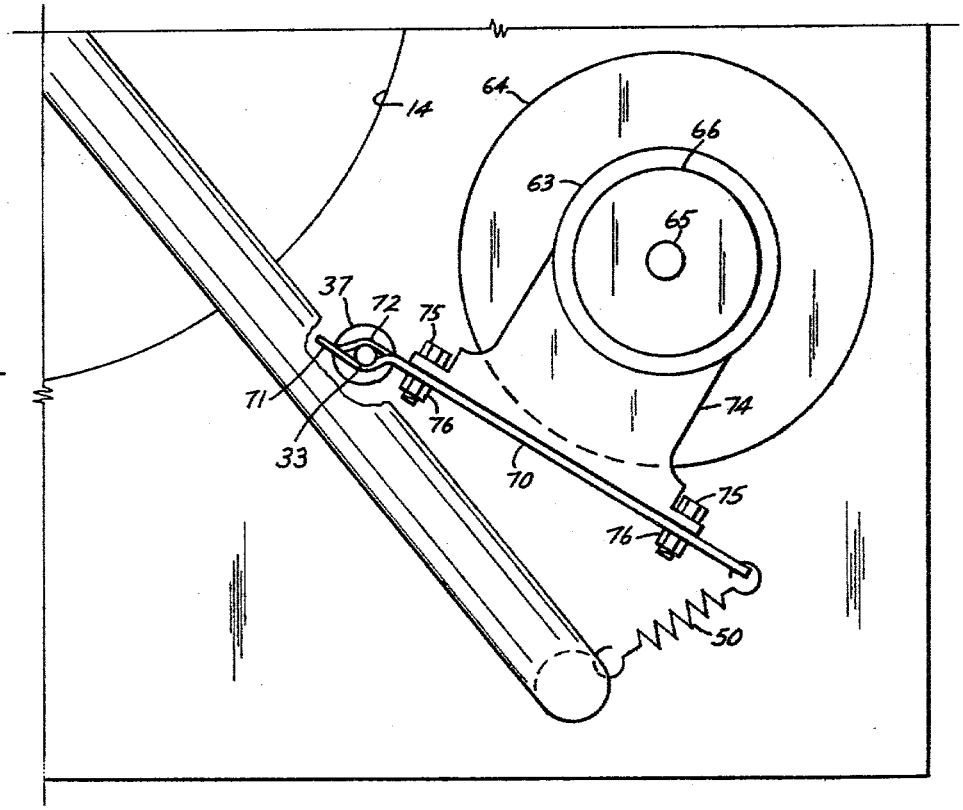
Fig. 3 PRIOR ART
FIG. 3 is a upper elevation similar to FIG. 2 showing the conventional structure for the apparatus.

The difference between the present structure and that conventionally used for mounting the electric motor 64 is illustrated by comparison of the showings of FIGS. 2 and 3. FIG. 2 has already been described. In FIG. 3, which for comparison shows a conventional manner for support of motor 64, there is shown a plate 70 which has tabs 71 having outbent strip portions 72 between parallel cuts thereof, in a manner similar to that shown in FIG. 5. In this manner, the plate 70 is pivotally connected to a shaft 18, supported by a collar 37. The motor 64 is provided at each end with motor mounts or support fittings 74 which are bolted to plate 70 by bolts 75 and nuts 76. Washers may be employed between the nuts and plate 70. The motor mounting element or elements 74 are customarily purchased from the manufacturer, at a considerably greater expense than the cost of element 43, which provides all of the functions of plate 70 plus the functions of element or elements 74. The cost of the structure shown in FIG. 2 is considerably less than the cost of the structure shown in FIG. 3, and is simplier to install and requires no adjustment. The position of motor 64 in FIG. 3 is adjustable with respect to the bolt holes through plate 70, and it is difficult to align motor 64 by adjustment of the bolts 75 if such adjustment should be necessary. In the FIG. 2 structure, no misalignment of the motor may occur, as the motor is in a fixed, unchangeable, position with respect to the portions 51, 52 of element 43. Therefore, no misalignment of the motor 64 may occur using the embodiment shown in FIG. 2 of the drawings, and no adjustment of the motor position is ever required.

The apparatus according to the invention is much more economical than the conventional equipment, and is lighter in weight and easier to assemble.

Another feature of the invention is the use of a multi-V-belt to connect the drive motor sheave 66 to drive plate 16 in rotation. The multi-V-belt, which may have two or more V-shaped ribs, provides greater strength and less wear than a single V-belt conventionally used with attic fan apparatuses. Since no sheave is required at shaft 18, a V-belt having any number of V-shaped ribs may be used by provision of a sheave 66 having the proper number of grooves, with no change being necessary to plate 16 and flange 16*a* because of any change in the number of V-ribs of the belt.

While a preferred embodiment of the apparatus according to the invention is described and shown in the drawings, many modifications thereof may be made by a person skilled in the art without departing from the spirit of the invention, and it is intended to protect by Letters Patent all forms of the invention falling within the scope of the following claims.

I claim:

1. Attic fan, comprising a housing having a plate having a circular opening therethrough, a blade shaft concentric of said opening supporting plural circularly spaced radially disposed air impeller blades for rotation within said opening, pulley means associated with said blade shaft which when rotated rotates said blades, an electric drive motor supported by a motor support shaft disposed transverse to said plate and having sheave means carried on its drive shaft, drive belt means engaged about said sheave means and said pulley means whereby said pulley means is rotated when said motor is operated, means biasing said motor in a direction away from said blade shaft to maintain said drive belt means in tightened condition about said sheave means and said pulley means, said blade shaft being supported beneath said blades by a plurality of circularly spaced lower radial arms depending between said housing and said blade shaft, said blade shaft being supported above said blades by an upper radial arm depending between said housing and said blade shaft, said drive belt means being a V-belt, said sheave means having belt groove means therearound with which said V-belt is engaged, said pulley means including a cylindrical outer surface against which said V-belt is drivingly engaged, said air impeller blades being affixed at their inner ends between spaced upper and lower circular plates rotatably supported at their centers by said blade shaft, said cylindrical outer surface of said pulley means comprising an upstanding cylindrical flange depending from the outer periphery of said upper circular plate and being unitary therewith, said motor support shaft being fixed to said housing at its lower end and being fixed to said upper radial arm at its upper end.

2. The combination of claim 1, said upper radial arm having an intermediate bend, one end of said upper radial arm being fixed to said housing and the other end of said upper radial arm being fixed to the upper end of said blade shaft.

3. The combination of claim 2, including a motor support assembly comprising a unitary metal plate having parallel transverse portions at its upper and lower ends, means for pivotally connecting a vertical edge of said plate to said motor support shaft, means for vertically supporting said plate on said motor support shaft, each said transverse portion having an arcuate end adapted to be received against a support surface at one end of said motor and each having laterally extending engagement means at each end of said arcuate end, and a pair of arcuate straps associated with each said transverse portion each engaging one of said engagement means of a said transverse portion at one end and being disposed about the opposite side of the support surface from said arcuate end and being adjustably connected together at the other end whereby a said support surface at each end of said motor is clamped within a said arcuate end and a said pair of said arcuate straps, whereby said motor is fully supported without use of conventional motor mount brackets, said motor biasing means comprising spring means urging said plate toward pivotal movement in a belt tightening direction about said motor support shaft.

4. The combination of claim 3, said other end of each said strap being outturned and having an opening therethrough, and a bolt disposed through said openings at said other ends of each said pair of straps having a nut screwed thereonto, said other ends of each said pair of straps being drawn together to tighten said straps about a said support surface of said motor when said nuts are tightened on said bolts.

5. The combination of claim 2, including a motor support assembly comprising a plate pivotally supported by said motor support shaft along an edge thereof, said plate having first clamp means at its upper end for clampingly engaging an upper end portion of said motor and having second clamp means at its lower end for clampingly engaging a lower end portion of said motor, whereby said motor is fully supported without use of conventional motor mount brackets, said motor biasing means comprising spring means urging said plate toward pivotal movement in a belt tightening direction about said motor support shaft.

* * * * *